United States Patent [19]

Itoi

[11] Patent Number: 4,476,587

[45] Date of Patent: Oct. 16, 1984

[54] CONVERTIBLE GARMENT

[76] Inventor: Toru Itoi, 861-11 Komatsuri-cho, Kishiwada-shi, Osaka, Japan

[21] Appl. No.: 455,483

[22] Filed: Jan. 4, 1983

[51] Int. Cl.[3] ..... A41D 1/00

[52] U.S. Cl. ..... 2/94

[58] Field of Search ..... 2/94, 88, 108, 84, 85

[56] References Cited

U.S. PATENT DOCUMENTS

| | | | |
|---|---|---|---|
| 2,058,474 | 10/1936 | Long | 2/85 |
| 2,959,789 | 11/1960 | Mills et al. | 2/93 |
| 4,347,629 | 9/1982 | Itoi | 2/108 |
| 4,351,066 | 9/1982 | Pearsall | 2/85 |

*Primary Examiner*—Doris L. Troutman

*Attorney, Agent, or Firm*—McAulay, Fields, Fisher, Goldstein & Nissen

[57] ABSTRACT

A garment is provided with first and second fastener tracks such as to extend transversely across respective front and back parts of its trunk portion. The fastener tracks can be fastened together with a portion of the garment other than a portion under these fastener tracks accommodated in the space defined by the portion under the fastener tracks. In this form, the garment can be used as a knapsack to be carried along on the back. Thus, it is possible to avoid losing the garment after it is taken off. Also, there is no need for the garment to occupy either hand when it is carried along. Further, small-sized goods may be carried along in the knapsack thus formed.

10 Claims, 7 Drawing Figures

CONVERTIBLE GARMENT

BACKGROUND OF THE INVENTION

This invention relates to an article useful as outerwear. It is often necessary to remove outer garments as the ambient temperature increases. In most cases, there is no place to store the garment removed so that one has to carry it along, that is, a hand is inevitably tied up by the garment. Also, there is a possibility that the garment may be lost. Moreover, when it is also necessary to carry other items, one has his hands already full.

SUMMARY OF THE INVENTION

A primary object of the invention, accordingly, is to provide a convertible article useful as outwear and a carrying bag or knapsack by putting some of it into the rest.

A second object of the invention is to provide a convertible garment, which can be used as a bag or knapsack to carry small-sized goods in it.

A third object of the invention is to provide a convertible garment, which can be carried along on the back in the form of a knapsack with its fastening strings passed round the shoulders.

BRIEF DESCRIPTION OF THE DRAWINGS

The above and further objects, features and advantages of the invention will become more apparent from the following description when the same is read with reference to the accompanying drawings, in which.

DETAILED DESCRIPTION OF PREFERRED EMBODIMENTS

Figure 4:
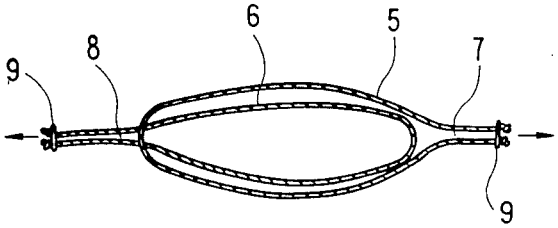
FIG. 4 is a view showing an example of fastening strings retained along the lower edge of the garment.

As illustrated in FIGS. 1 through 4, a convertible garment 1 capable of being used both as a jacket and as a knapsack according to the invention essentially comprises a trunk portion 2, sleeve portions 3 and a hood portion 4. The trunk portion 2 is provided along its lower edge with a string retainer portion 19. Two fastening strings 5 and 6 are inserted and retained in the string retainer tube 19 in a looped form as shown in FIG. 4. End portions 7 and 8 of the fastening strings 5 and 6 protrude from the string retainer portion 19 to the outside. The opposite end portions 7 and 8 of the respective fastening strings 5 and 6 are tied by short bars 9 so that they can be readily pulled out.

In the trunk portion 2, a fastener track 12 is provided to extend transversely across the front part 10 of the trunk portion 2. Also, a second fastener track 13 is provided to extend transversely across the back part 11 of the trunk portion 2. These first and second fastener tracks 12 and 13 are provided on the trunk portion 2 slightly below the sleeve portions 3. The first and second fastener tracks 12 and 13 constitute a fastener which can be fastened and released with a slider 14. The trunk portion 2 is further provided in its back part 11 and near the opposite ends of the second fastener track 13 with hooks 15 and 16, on which the ends 7 and 8 of the fastening strings 5 and 6 can be hooked. A breast portion 20 of the garment 1 is provided with a fastener 16 which can be fastened and released. The front part 10 of the garment 1 is provided with a pocket 18 which can be opened and closed with a fastener 17.

Figure 1:
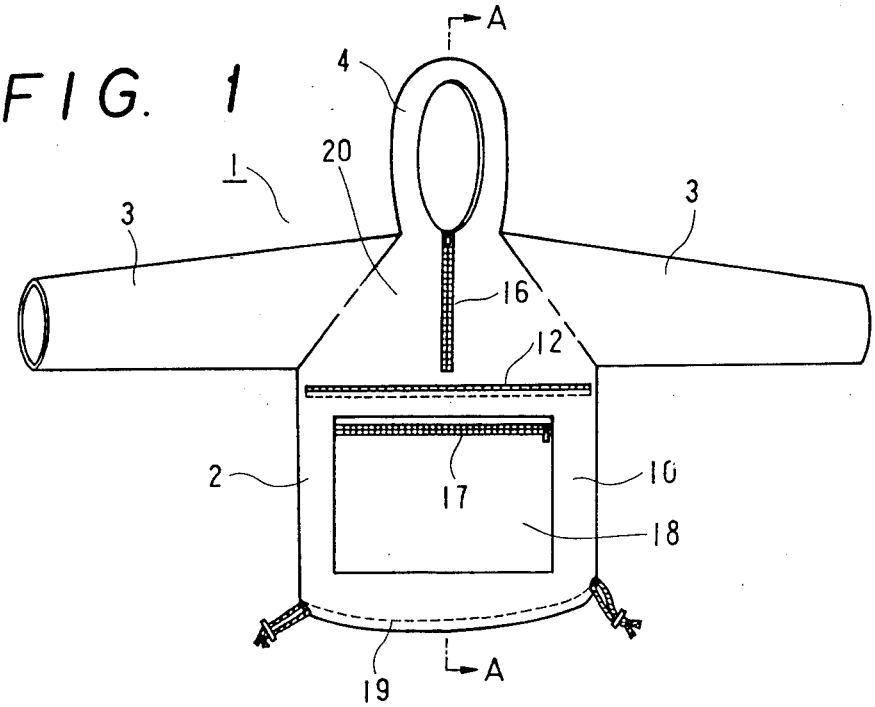
FIGS. 1 and 2 are respectively front and back views showing an embodiment of the convertible garment of the invention unfolded.
Figure 2:
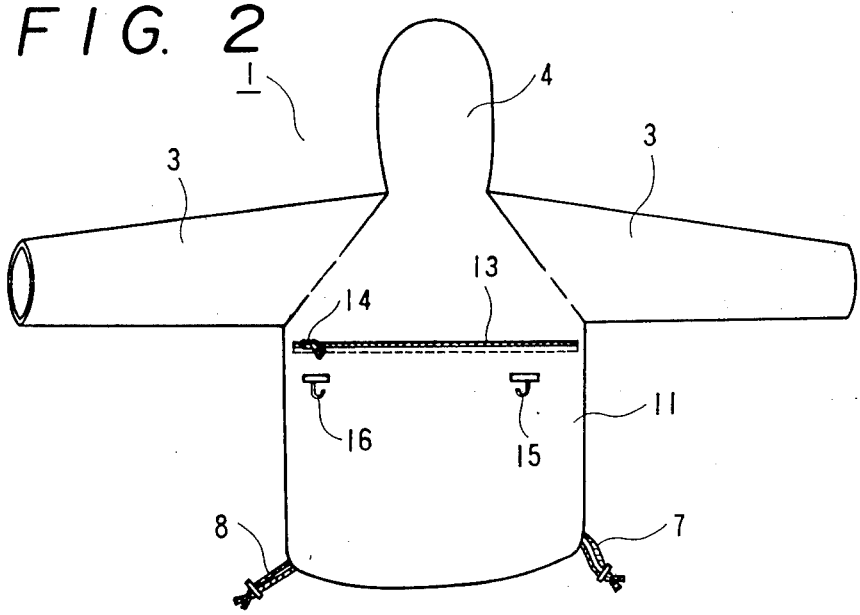
Figure 3:
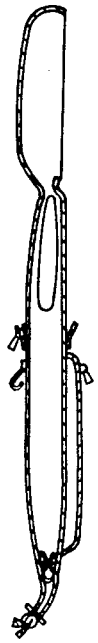
FIG. 3 is a sectional view taken along line A—A in FIG. 1.
Figure 6:
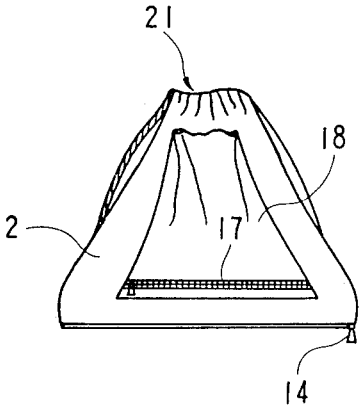
FIGS. 6 and 7 are views showing the garment converted into a knapsack.
Figure 5:
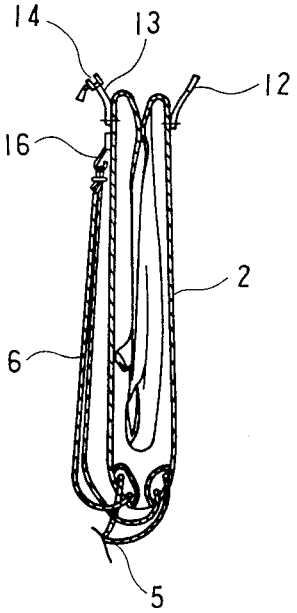
FIG. 5 is a sectional view showing the garment folded to form a knapsack.
Figure 7:
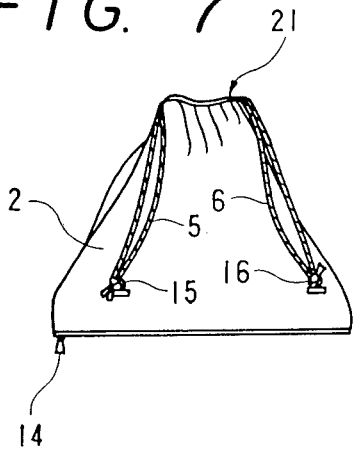

The convertible garment as described above can be worn as a jacket in the form shown in FIGS. 1 and 2 when going on a hike. When the garment 1 is no longer worn, it can be converted to a bag or knapsack. FIG. 5 shows the garment 1 folded by putting the sleeve portions 3, the hood portion 4 and the breast portion 20 of the trunk portion 2, i.e., the portion of the garment 1 above the fastener tracks 12 and 13, into the rest of the trunk portion 2 and then fastening together the fastener tracks 12 and 13 with slider 14. FIGS. 6 and 7 show a knapsack that is obtained by subsequently pulling out the end portions 7 and 8 of the fastening strings 5 and 6 and hooking them on the hooks 15 and 16. In the knapsack thus formed, an opening 21 is constituted by the lower edge of the trunk portion 2, along which the fastening strings 5 and 6 are retained. Small-sized goods can be put into this knapsack and carried along with it. This knapsack can be carried on the back with the strings 5 and 6 passed round the shoulders. Further, the knapsack can be carried along without the fastening strings 5 and 6 hooked on the hooks 15 and 16 but with the strings 5 and 6 gripped by hand.

What is claimed is:

1. A convertible article useful as outerwear and as a carrying bag or knapsack, comprising:

a trunk portion adapted to fit over the torso of the wearer's body and having sleeves extending therefrom;

said portion including a front part and a back part;

a neck-receiving opening at the upper part of said trunk portion for allowing passage of the wearer's head when said article is worn;

a hood portion about said opening;

first and second fastener tracks extending transversely across said front and back parts respectively;

said tracks constituting fastening means along with a slider;

a drawstring at the lower edge of said trunk portion, said drawstring having ends extending outside said trunk portion;

hook means near the opposite ends of said second fastener track adapted to receive said ends of said drawstring so that said article can be carried on the shoulders as a carrying bag or knapsack with the portion of said article above said fastener tracks in the rest of said trunk portion with said fastener tracks fastened together with said slider; and an opening in said trunk portion formed by said lower edge of said trunk portion.

2. The article of claim 1, including:

a tube formed in the lower edge of said trunk portion;

said drawstring consisting of a pair of strings retained in said tube in loop form with ends protruding from said tube and tied by pegs to facilitate pulling out.

3. The article of claim 1, wherein the front part of said trunk portion has a pocket.

4. The article of claim 1, wherein said front part of said trunk portion has a breast portion with a vertical fastener extending to said neck opening.

5. The article of claim 2, wherein the front part of said trunk portion has a pocket.

6. The article of claim 2, wherein said front part of said trunk portion has a breast portion with a vertical fastener extending to said neck opening.

7. The article of claim 5, wherein said front part of said trunk portion has a breast portion with a vertical fastener extending to said neck opening.

8. A convertible article useful as outerwear and as a carrying bag or knapsack, comprising:

a trunk portion adapted to fit over the torso of the wearer's body; said trunk portion having sleeves extending therefrom, and including a front part and a back part;

a neck-receiving opening at the upper part of said trunk portion for allowing passage of the wearer's head when said article is worn;

a hood portion about said opening;

first and second fastener tracks extending transversely across said front and back parts, respectively, said tracks together with a slider constituting fastening means;

a drawstring at the lower edge of said trunk portion, said drawstring having ends extending outside said trunk portion;

hook means near the opposite ends of said second fastener track adapted to receive said ends of said drawstring so that said article can be carried on the shoulders as a carrying bag or knapsack with the portion of said article above said fastener tracks in the rest of said trunk portion with said fastener tracks fastened together with said slider; and an opening in said trunk portion formed by said lower edge of said trunk portion.

9. The article of claim 1, wherein a retainer tube is formed in the lower edge of said trunk portion, and said drawstring consists of a pair of strings retained in said tube in loop form with ends protruding from said tube and tied by pegs to facilitate pulling out.

10. The convertible article of claim 8, wherein said fastener tracks are slightly below said sleeves.

* * * * *